US007090382B2

(12) United States Patent
Haddad et al.

(10) Patent No.: US 7,090,382 B2
(45) Date of Patent: Aug. 15, 2006

(54) MODULAR POLE SYSTEM FOR A LIGHT FIXTURE

(75) Inventors: Eric O. M. Haddad, East Berlin, PA (US); Donald Fentress, Fulton, MD (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 11/052,450

(22) Filed: Feb. 7, 2005

(65) Prior Publication Data

US 2005/0146864 A1 Jul. 7, 2005

Related U.S. Application Data

(63) Continuation of application No. 10/267,416, filed on Oct. 9, 2002, now Pat. No. 6,851,838.

(51) Int. Cl.
*F21S 13/10* (2006.01)

(52) U.S. Cl. ..... 362/431; 362/414; 52/726.4

(58) Field of Classification Search ..... 362/145, 362/431, 410, 414, 415, 806; 52/726.4; 40/607.01, 40/607.1, 607.03
See application file for complete search history.

(56) References Cited

U.S. PATENT DOCUMENTS 1,481,187 A * 1/1924 Clay ..... 52/295
1,776,682 A 9/1930 King
1,903,907 A * 4/1933 Riemenschneider ..... 362/431
1,906,508 A 5/1933 Arbogast
3,813,837 A 6/1974 McClain et al.
3,833,804 A 9/1974 Vesely
3,974,372 A 8/1976 Cochran
4,523,263 A 6/1985 Poyer
4,564,890 A 1/1986 Poyer
4,701,577 A 10/1987 Bourrieres
4,803,819 A 2/1989 Kelsey
4,951,182 A 8/1990 Simonson et al.
5,513,477 A 5/1996 Farber
5,572,846 A 11/1996 Sosa
5,775,035 A 7/1998 Papin
5,870,877 A 2/1999 Turner
6,027,228 A 2/2000 Adams et al.
6,155,017 A 12/2000 Turner
6,164,803 A 12/2000 Reniger et al.
6,167,673 B1 1/2001 Fournier
6,322,863 B1 11/2001 Kubicky
6,327,833 B1 12/2001 Miskelley et al.
6,389,760 B1 5/2002 McDonnell

* cited by examiner

*Primary Examiner*—Ali Alavi
*Assistant Examiner*—B Q T
(74) *Attorney, Agent, or Firm*—James E. Cole; Middleton Reutlinger

(57) ABSTRACT

A modular pole system and light fixture is disclosed including an internal skeletal structure and an external plastic shell. The external plastic shell may slide over the assembled internal skeletal structure and may be a singular unit. The internal skeletal structure may be an upwardly extending tapered pole which is held in place by a base and post which also provides a static structure acting as a passive defense mechanism.

15 Claims, 11 Drawing Sheets

MODULAR POLE SYSTEM FOR A LIGHT FIXTURE

CROSS REFERENCE TO RELATED APPLICATION

This application is a continuation application of patent application Ser. No. 10/267,416, filed Oct. 9, 2002, now issued as U.S. Pat. No. 6,851,838.

BACKGROUND OF THE INVENTION

1. Technical Field of the Invention

The present invention relates to a modular pole system which supports a light fixture, the modular pole system having a decorative non-load bearing outer cover encasing a load bearing inner skeleton which may also act as a passive defense mechanism.

2. Review of the Prior Art

Full length lighting standards have been utilized in the prior art and are typically made of cast iron or other metallized product throughout. Problematic with these designs is the weight of the overall lighting standard and the difficulty in casting the iron in the proper decorative format. Further difficulties involved with utilizing decorative metal lighting standards is the degradation of appearance due to environment or other external factors. Thus, after extended periods of use, previously known ornamental lighting standards tend to show increasing wear, become problematic for repair, are fairly expensive from a manufacturing point of view, and overall tend to be inefficient in the use of materials. Additional problems with prior art ornamental lighting standards exist in that they have previously further been utilized in segmented form due to their weight, wherein multiple segments are added upon each other to create the upwardly extending lighting standard. Such weight issues required extensive lifting machinery to install the standard, exceptionally strong anchoring bolts to ensure vertical stability, affixation brackets necessary to attaching the fixture directly to the standard or metallized external portion of the standard and other structural enhancements and support for maintaining the standard in proper upright and stable form.

An additional problem with the prior art lighting standards exist in the vulnerability for the lighting standards to be collapsed or even destroyed after impact from an automobile or other heavy vehicle. It may therefore be desirable to combine both a lightweight decorative unitary structure forming an ornamental lighting standard with an internal skeletal structure which may combine to perform as a passive defense measure. None of the prior art decorative lighting standards provide a sufficient decorative lightweight appearance in combination with a strengthened structural support which may form a passive defense measure.

SUMMARY OF THE INVENTION

The modular pole system for a light fixture of the present invention solves the drawbacks and deficiencies of prior art decorative lighting standards in that the decorative lighting standard of the present design is a modular system comprised of a load bearing internal skeletal structure having a steel base plate and support tube in combination with a non-load bearing decorative lightweight exterior shell which, when used in combination, performs as a static structure which may act as a passive defense measure while also providing a unique decorative lighting standard.

It is an object of the present invention is to provide a decorative and ornamental lighting standard which is modular in design and which has a lightweight decorative non-load bearing exterior shell supported on a load-bearing internal skeletal structure, the internal skeletal structure modified so as to be affixed to the lighting fixture and have a strengthened base plate and base tube or post.

It is another object of the present invention to provide a modular pole system for a light fixture which creates an ornamental lighting standard acting as a passive defense measure.

It is a further object of the present invention to provide an ornamental decorative lighting standard which is a static structure which is strong enough to impede the path of cars, sport utility vehicle or other light to medium vehicles as well as larger or heavier transports while also providing a decorative exterior support for a light fixture.

An even further object of the present invention is to provide an ornamental lighting standard which has an ornate external non-load bearing high impact plastic shell which masks the load bearing structural support and steel base plate contained there beneath.

A further object of the present invention is to take advantage of the durability of plastics and other polymers for creation of an ornamental external lighting standard and combining such an exterior structure with an internal load bearing skeletal structure and base which performs as a defensive steel base and post preventing vehicles and other transports from overrunning the ornamental lighting standard.

It a further object of the present invention to combine the internal strength of the steel or aluminum load bearing understructure with the external aesthetic surface of a molded plastic design wherein the external decorative plastic is a non-load bearing slipover one piece cover.

The modular pole system for light fixtures of the present invention combines an external ornamental lighting standard which is plastic, the plastic being molded to color wherein the color runs through the entire product and wherein the internal load bearing skeleton structure over which the shell slips is constructed of a tapered aluminum or galvanized steel pole which rests in a unitary galvanized steel base plate and base tube or post. The non-load bearing external shell may be constructed of a polymer which is resistant to environmental degradation and abrasion resistant while further having a strength exceeding typical epoxy, common nylon or PVC. The modular pole system for a light fixture of the present invention further has a load bearing internal skeleton structure affixed to the light fixture at a top end and which may be made of galvanized steel wherein the galvanized steel base and base tube support a tapered aluminum or galvanized steel pole, the plastic shell slipping over a tapered or non-tapered pole. The steel base plate is of sufficient width to support the entire structure while also acting as a passive defense measure maintained within a static structure which prevents vehicles from passing over the whole system.

These and other objects are met by the modular pole system for a light fixture of the present invention.

All of the above outlined objectives are to be understood as exemplary only and many more objectives of the invention may be adapted from the disclosure herein. Therefore no limiting interpretation of the objectives noted are to be understood without further reading of the entire specification, claims and drawings included herewith.

DESCRIPTION OF THE FIGURES

A better understanding of the modular pole system for light fixture of the present invention may be had by reference to the attached drawings, wherein like numerals referred to like elements and wherein.

DETAILED DESCRIPTION OF THE PREFERRED EMBODIMENT

Figure 1:
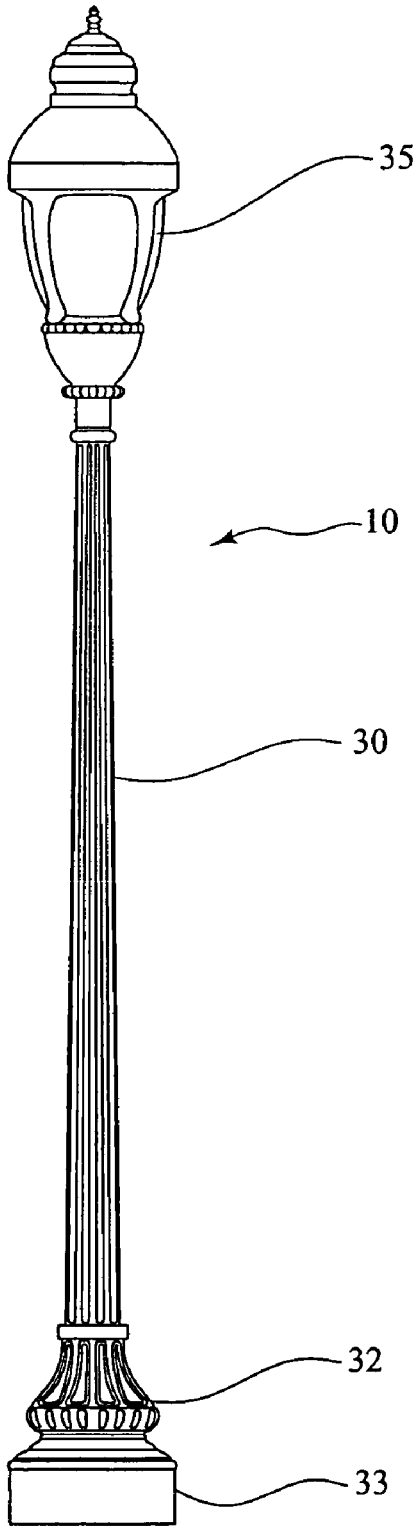
FIG. 1 is a front view of the modular pole system and light fixture of the present invention.

The modular pole system and light fixture 10 of the present invention is shown in FIG. 1. As can be seen from the external surfacing therein, the modular pole system 10 of the present invention is constructed on its exterior surface of a light fixture 35, a non-load bearing decorative shell 30, a shell base 32 and a shell base cover 33, all of which may be unitary in construction. From its exterior appearance, the modular pole system and light fixture 10 of the present invention appears to be constructed of standard aluminum or steel finish with typical ornamental surfacing on the support pole which extends downward from the bottom end of the light fixture 35. Thus, the decorative non-load bearing shell 30 may have fluting, decorative finishes, ornamental appearance and coloring that are typically found in normal light support pole systems. Additionally, the shell base and base cover 32 and 33 may similarly be colored and have decorative finishes which are normally found in typical metalized products. Upon closer inspection however, the exterior covering of the modular pole system 10 of the present invention discloses that the vertically extending shell, shell base and base cover 30, 32 and 33 are constructed of a high durability and resilient unitary plastic structure which extends from the base cover to the bottom end of the light fixture 35. Such a unitary construction allows for easy assembly and installation with the lightweight exterior readily installable over an internal load-bearing support skeleton or skeletal structure 10*a*.

The decorative non-load bearing external shell 30 for the modular pole system 10 of the present invention is made of a single shell plastic which extends upward from a base cover 33 and which ends adjacent to the light fixture 35. The high impact plastic is molded into the shape of a vertically extending pole and shell base cover and provides an extremely high level of ultra-violet and environmental protection as compared to prior aluminum, steel or other metalized products. The external shell 30 additionally is a decorative shell which slips over the internal load bearing support skeleton 10*a* and does not support any load form the light fixture or other parts of the system. These plastics offer environmental and corrosion resistance, abrasion resistance, salt spray resistance and a strength which typically exceeds those of prior art epoxy, nylon, PVC or other fielded materials. The plastics, while providing a high level of environmental corrosion resistance, additionally provide coloring and do not require painting on their exterior surface. The shells which forms the exterior surface may be molded to color with the selected hue running through the entire shell product. The decorative shell 30 can be molded for the vertically extending pole and shell base and base cover as a single unit in any defined or required texture or contour and may also be constructed of non-modular units.

Figure 2A:
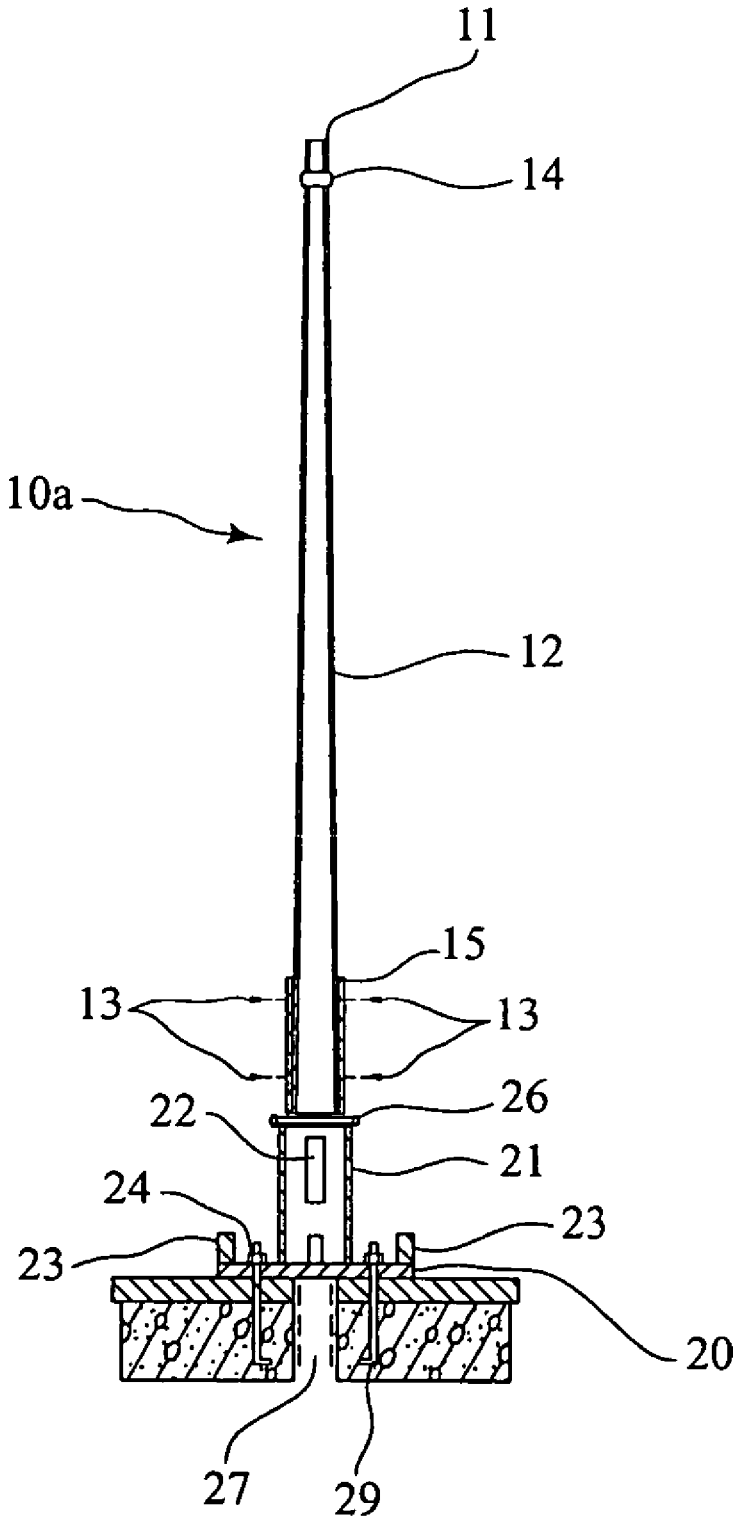
FIG. 2*a* is a side view of the internal skeletal structure of the pole system setforth in FIG. 1.

As depicted in FIG. 2*a*, the underlying skeletal structure 10*a* for the modular pole system 10 of the present invention is constructed of a tapered pole 12 which fits into a post 21 extending upward from the post base 20. The internal skeletal structure 10*a* is a load bearing skeletal structure which supports the weight of the light fixture 35 and also of the shell 30.

As depicted in FIG. 2*a* in partially unassembled form, the tapered pole 12 may be made of an aluminum shaft and may slip into the post 21 and base 20. Post 21 and base 20 may be constructed of a galvanized solid steel product for increasing the strength of the underlying internal skeletal structure 10*a*. Such a construction mates the high impact plastic of the decorative external shell 30 with the structural integrity of the aluminum or steel pole 12 and steel base and post 20 and 21. Alternatively, the internal skeletal structure 10*a* may be a unitary load bearing support structure which is surrounded by the external decorative shell 30.

As depicted, the pole 12 tapers slightly as it extends upward to a load bearing upper end where collar 14 is positioned in order to add stability to the exterior plastic shell 30 while also preventing movement thereof. The upper end 11 of the pole also provides a positioning area for anchoring of the light fixture 35. The upper end 11 of the pole 12 is directly affixed to the fixture 35.

As seen in FIG. 2*a*, the tapered pole 12 may have at its lower end a slip fitter 15 which may surround the lower end of the pole 12 and which allows the pole 12 to securely rest within the steel post 21 and be secured therein by set screws 13. The slip fitter thus may allow for insertion of up to 6 set screws which may be placed along two tiers at 120° in order to secure the pole 12 into the post 21. Other securing mechanisms may be utilized however to secure the pole 12 into post 21 which may include direct insertion and friction fit.

Access to the wiring which runs up through the conduit through the ground and inside the interior of the pole 12 may be provided through two aligned access openings 22 which are formed in the slip fitter 15 and the lower portion of the tapered pole 12, each of which may be rotated prior to assembly in order to match up with each other. The access opening 22 thereby provides access to the hollow interior of the pole 12. The post 21 may or may not have access opening formed therein, the non-inclusion of which may increase the structural rigidity of the post 21.

Figure 2B:
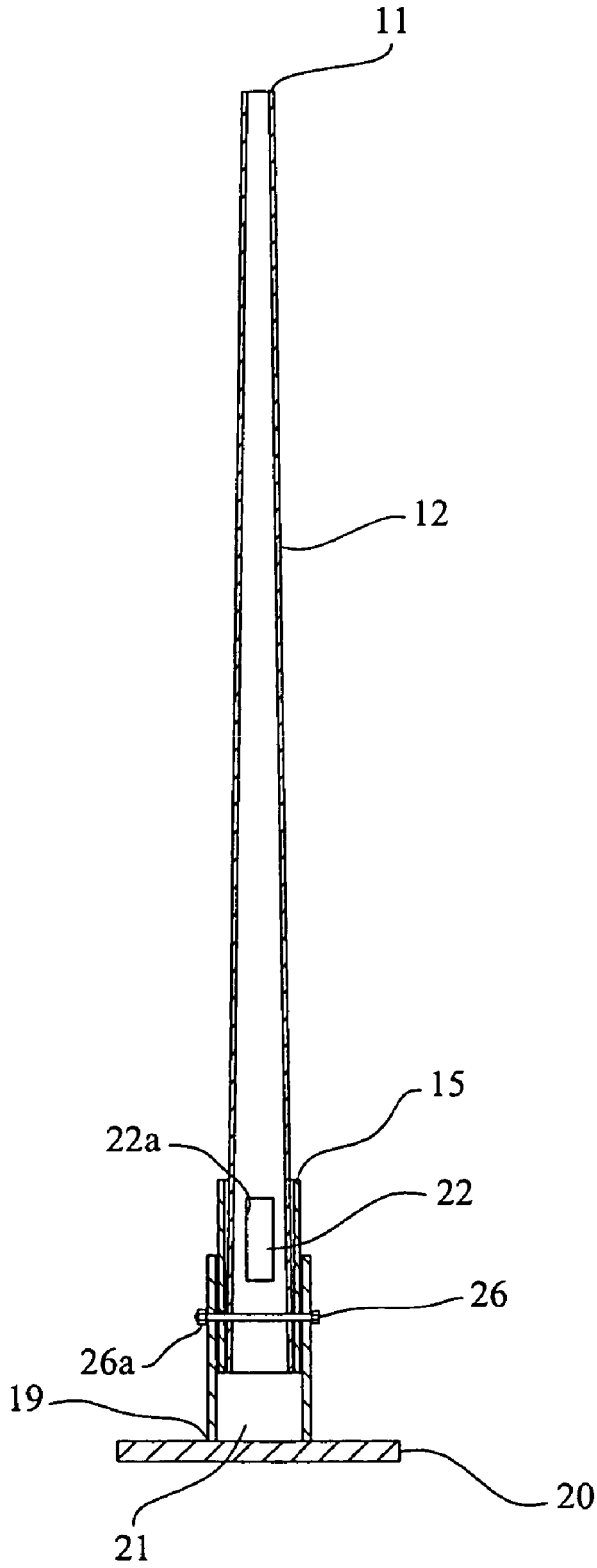
FIG. 2*b* is a partial side sectional view of the internal skeletal structure shown in FIG. 2*a* fully assembled.
Figure 4:
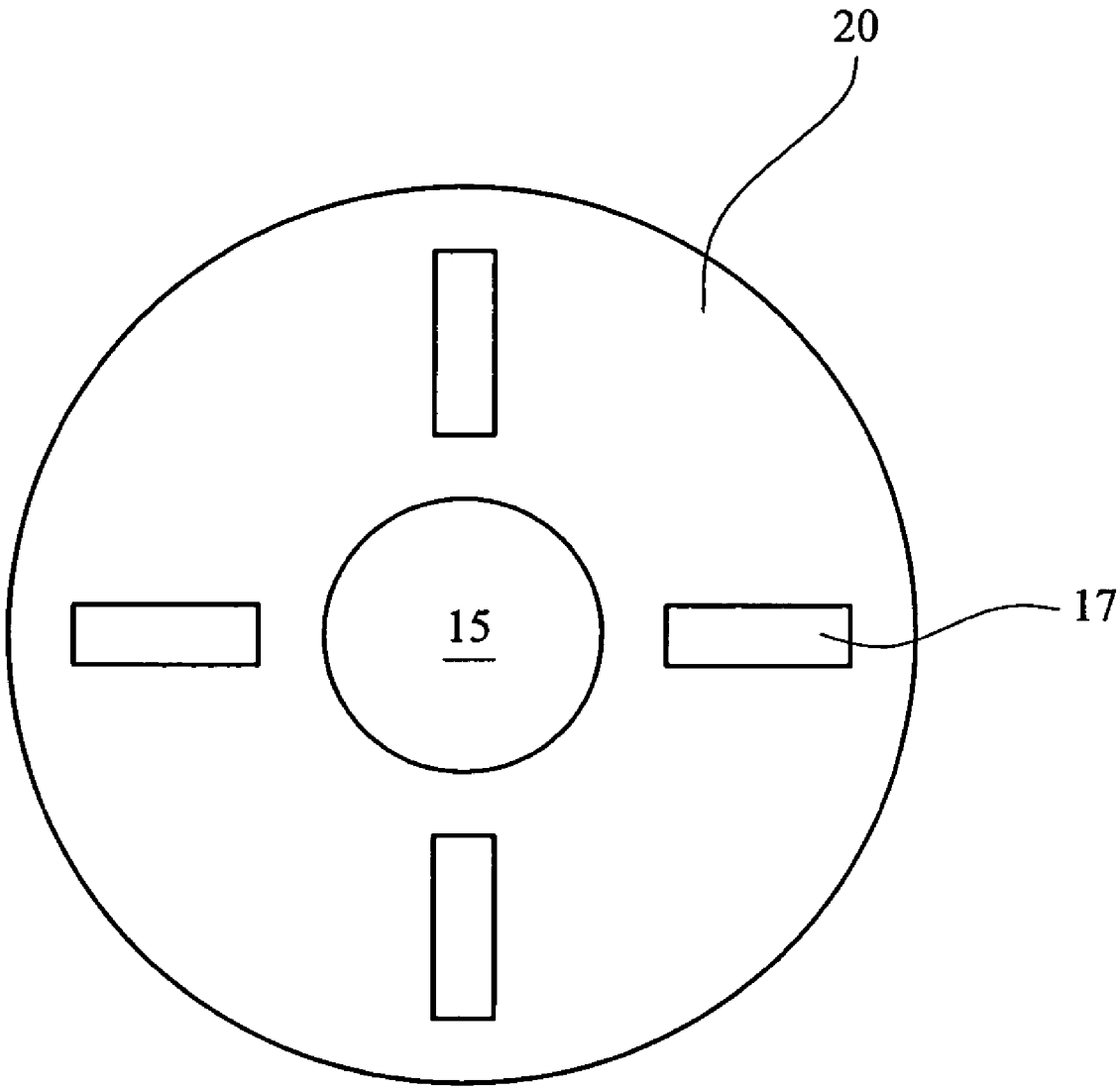
FIG. 4 is a top view of the base plate for use with the modular pole system of the present invention.

As can be seen in combination with FIG. 2*a* and FIG. 2*b*, the tapered pole 12 and slip fitter 15 are inserted into the open end of the post 21 in order to secure the internal skeleton 10*a* upright. The hollow interior 22*a* of the tapered pole 12 may contain the wiring for electrical connection of the light fixture 35 through the conduit opening 27 and conduit aperture 15 formed in the steel base 20 as depicted in FIG. 4. The tapered pole 12 may be secured into the post 21 by the cross bolt 26 which may be a one inch diameter cross bolt running through all three elements, namely the post 21, slip fitter 15 and tapered pole 12. Cross bolt 26 may be secured at its opposite end by a double nut affixation mechanism to properly secure the upright positioning of the structure of the modular pole system 10 of the present invention.

As also depicted in FIG. 2*a,* the steel base 20 is secured to the ground by a plurality of bolts 24 which affix to anchor rods 29 inserted into the ground and which extend through the steel base 20. Steel base 20 has at its center conduit aperture 15 which aligns with conduit opening 27 in the ground for wiring of the light fixture 35. Anchor rods 29 extend downward through the ground and are affixed to the steel base through slotted openings 17. Additionally, while not shown in FIG. 4, a plurality of upwardly extending prongs 23 may be provided along the periphery of the steel base. The steel base 20, as shown, may have four slotted openings 17 in order to receive up to one inch anchor bolts 24 securing the anchor rods 29 which allow it to be oriented to fit atop existing anchor rods. The steel base 20 may have a diameter of 18 inches with a conduit opening 15 centrally located therein of about 4¾ to 5 inches. However, as can be appreciated, a number of configurations may be utilized for the steel base 20 utilized herein.

The steel base 20 and post 21 are a unitary structure and the post 21 may be welded to the base 20 if needed. The tapered pole 12 which extends into the post 21 may taper, for example, from upper diameter of 3 inches to a lower diameter of 5 inches.

The prongs 23 which are found on the periphery of the steel base may be positioned around the outer edge of the base 20 in order to capture the plastic shell 30 and in particular securely compress outward against the base cover 33 in order to add stability to the slip over shell 30. As can be appreciated from FIG. 2*b* and FIG. 3, once the internal skeletal structure 10*a* of the modular pole system 10 of the present invention is in place, the shell 30 can be slid over the top of the internal skeletal structure in its entirety and locked into place between the fixture 35 at the upper end 11 of pole 12 and ground when the light fixture 35 is added at the top of the tapered pole. The prongs 23 and the collar 14 may optionally be included and serve to secure the shell 30 from any side to side movement while the fixture 35, when added to the top end 11 of the load bearing pole 12 with its own set screws, sandwiches the shell 30 in place between the ground thereby securing the shell in place without any required fasteners.

The external shell 30 has a shell base 32 and base cover 33 at the lower end thereof. The base cover 33, as better shown in FIG. 3, has a continuous interior surface. By continuous interior surface it is meant that the inner surface thereof does not extend inwardly, as in a flange or other attachment tab, for connection to said base 20 or to anchor rods 29. As such, it is apparent that by having a continuous interior surface, the base cover 33 does not require assembly directly to the base 20 or post 21. By having a continuous interior surface, the base cover 33 may simply be slid over the entire internal skeletal structure of the modular pole system and particularly over the base 20 without any assembly steps. Such a feature is particularly useful when assembling the modular pole system described herein or replacing older street lighting thereby allowing for the internal skeletal structure to be assembled and the shell to be readily slid down over the top of the skeletal structure. Of course, optional affixation mechanism may be utilized to secure the non-load bearing decorative shell 30 to the load bearing support skeleton 10*a*.

Figure 10:
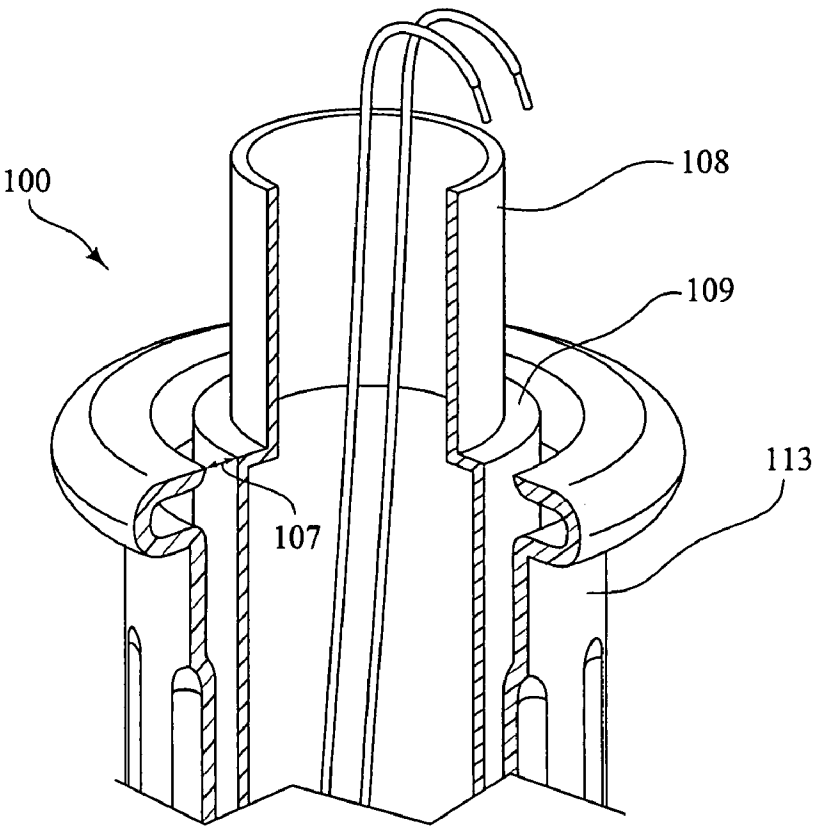
FIG. 10 is an additional side sectional view of the support pole and slip over cover embodiment of the present invention.
Figure 9:
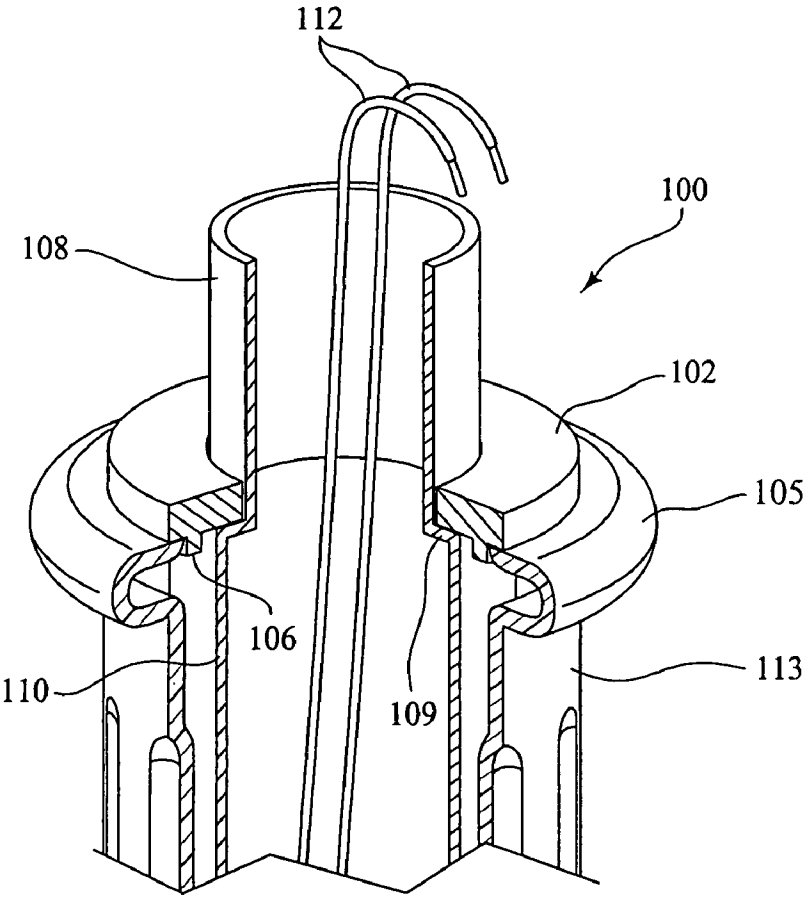
FIG. 9 is an additional side sectional view of the support pole and slip over cover embodiment of the present invention.
Figure 11:
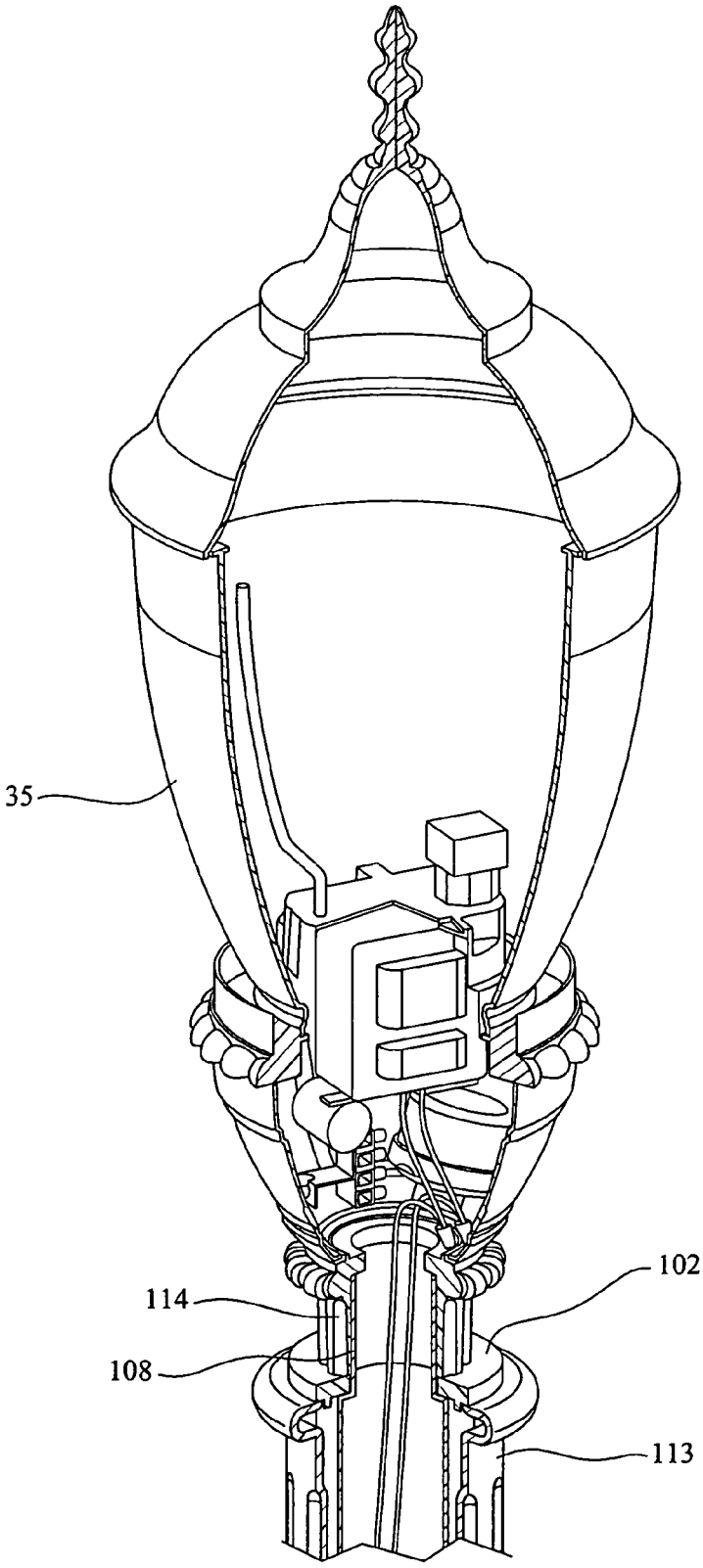
FIG. 11 is a sectional view of an additional embodiment of the module pole system of the present invention.

Installation of the fixture 35 is shown in FIGS. 9, 10 and 11 wherein fixture attachment 100 includes shell 113 which is shown extending upward to an upper end just below pole head 108 thereby exposing the pole head for affixation to fixture 35. Shell 113 extends upward to end 105 which may be aligned with tenon 109 of support pole 110. Shell 113 may be spaced from pole 110 by gap 107 so that it may be slipped over the top of the pole and installed readily. Gap 107 between the end 105 and tenon 109 may be closed by sleeve cap 102 which may rest upon an upper surface of end 105 and tenon 109. Sleeve cap 102 may be provided with spacer 106 to firmly separate the sleeve from the pole. Pole head 108 is exposed with wires 112 extending upward for electrical connection to fixture 35. While the support pole 110 shown has tenon 109, variations in the design of the upper end of the support pole 110 and the shell 113 may be provided for the ready attachment of the fixture to the pole 110 and the example shown is for explanatory purposes and not deemed to be limiting.

As displayed in FIG. 11, the fixture 35 is placed atop the pole head 108. Attachment cuff 114 of the fixture 35 is slid over exposed pole head 108 in order to attach the fixture to the pole and secure the shell in place. Pole head 108 provides sufficient exposed area for direct or indirect attachment of the fixture 35. As shown, sleeve cap 102 may remain exposed or, alternatively, may be covered by a lower end of the cuff 114. While the embodiment shown details fixture cuff 114 telescoping over the exterior of the pole head 108, many alternative affixation mechanisms may be provide such as inverted telescoping of the cuff 114 into the interior of the support pole or pole head.

Figure 12:
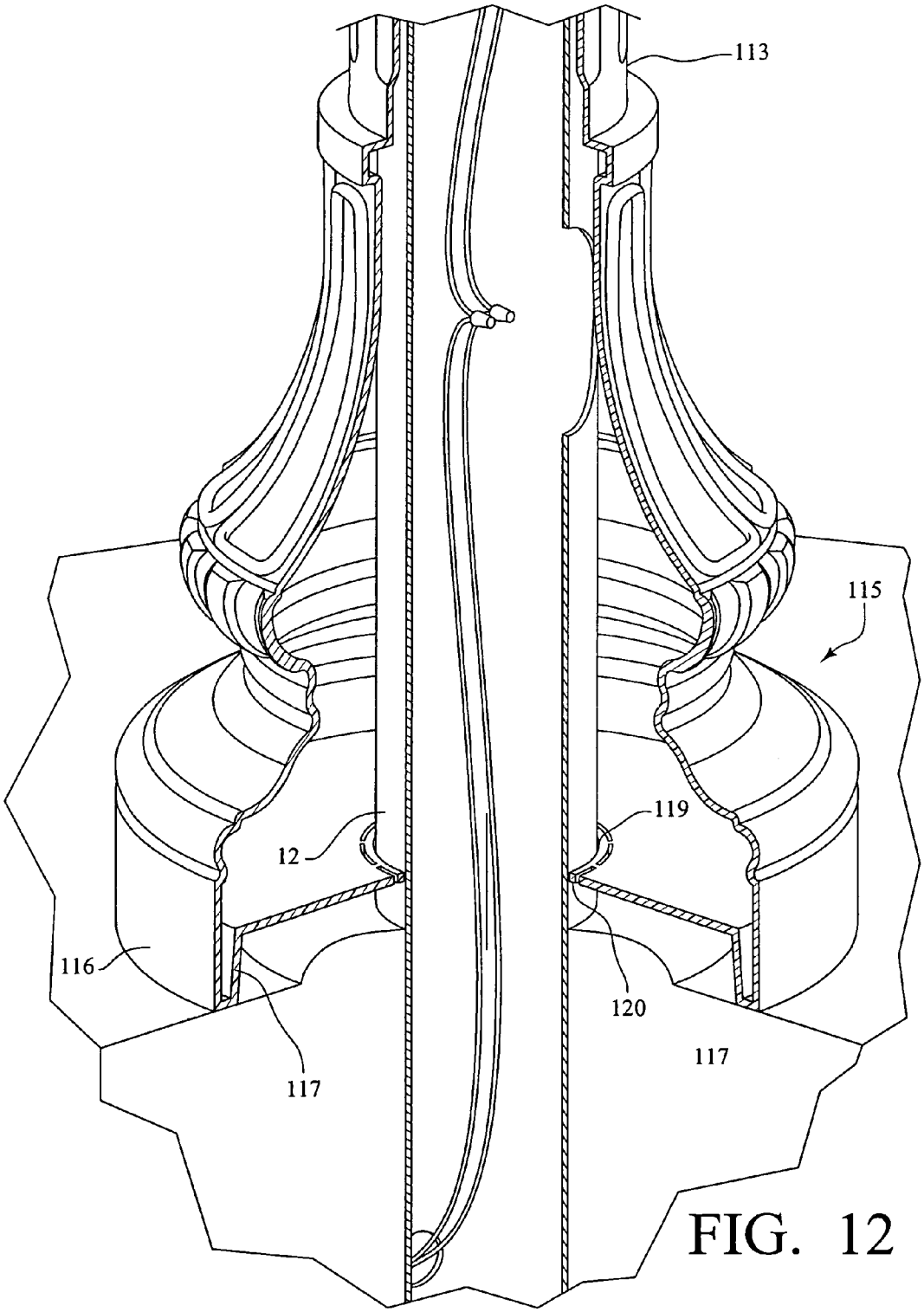
FIG. 12 is a side sectional view of an additional embodiment of the base portion of the slip over cover and internal support pole of the present invention.

FIG. 12 discloses an additional embodiment for installation of the support pole 12 and connection between base 116 thereof. As depicted, the shell-pole connection 115 may include the ability to merely slide the shell over the top of the support pole 12 and downward until the base 116 rests on the ground. Planar interior base 117 may extend inwardly towards pole 12 and may have a plurality of perforations 120 for adjustment of the shell interior aperture 119. Thus, shell 113 can appropriately be sized for varying diameter poles 12 and adjusted as required. Pole 12 extends downward through said interior aperture 119 and, in this embodiment, directly into the ground for securement of the pole in the vertical position.

Figure 6:
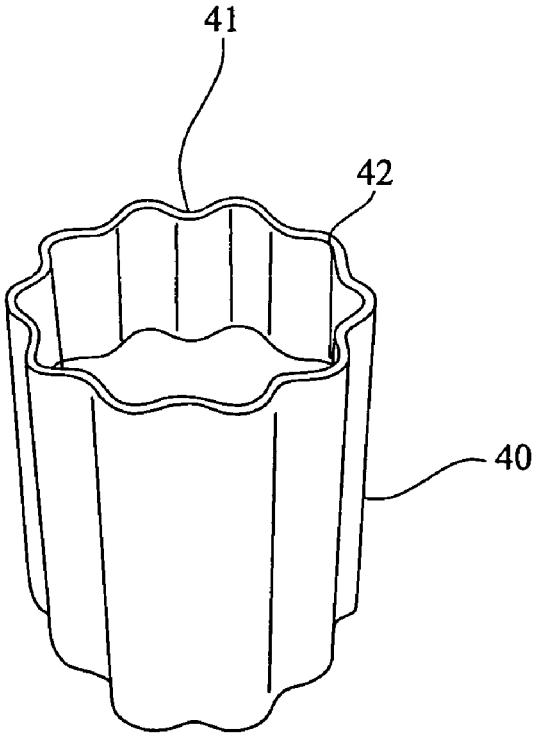
FIG. 6 is a perspective view of a anti-rotational mechanism for use in combination with the module pole system of the present invention.
Figure 7:
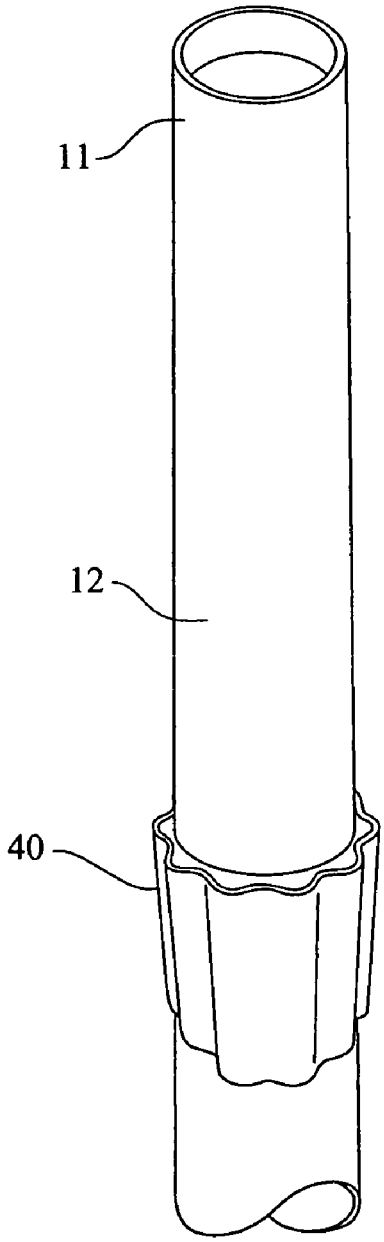
FIG. 7 is a perspective close-up view of the anti-rotational mechanism in stalled on the skeletal support pole of the present invention.
Figure 8:
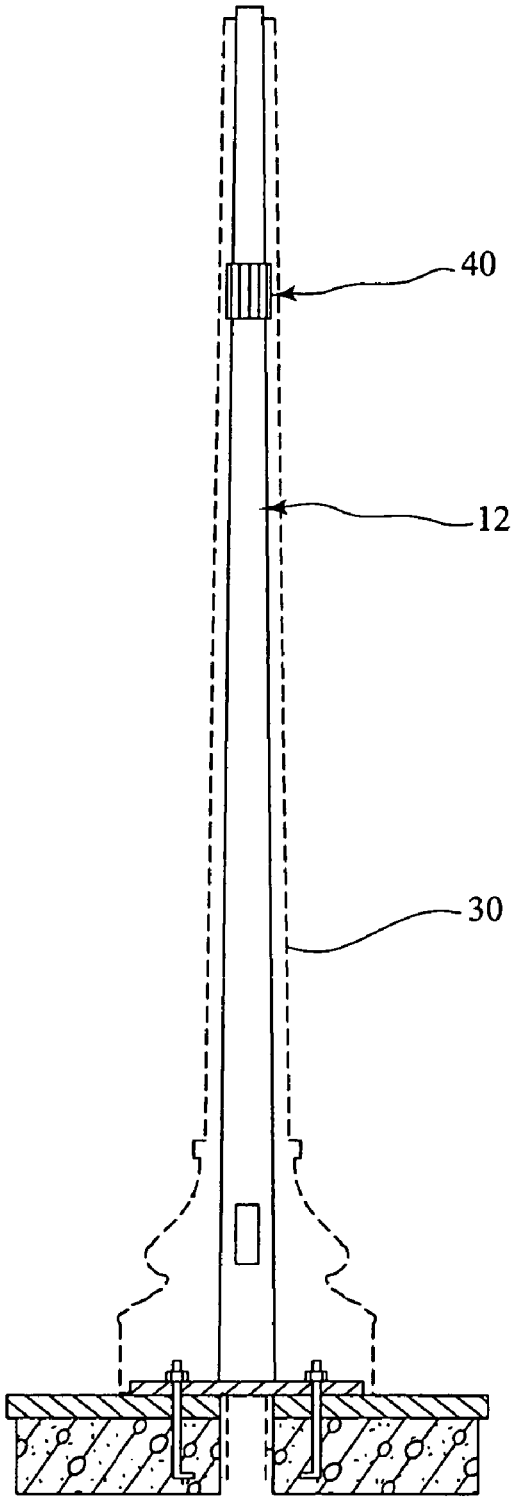
FIG. 8 is a side sectional view of the pole system of the present invention utilizing the non-rotational device of FIG. 6.

Additionally, as shown in FIG. 6-8, an anti-rotational device 40 may be installed over the pole 12 in order to secure and prevent rotation or other movement of the decorative shell 30. Anti-rotational device 40 may be a metal collar which has a series of flutes and ridges 41, 42 which allow the device 40 to slide over the upper end of the pole 11 and slide wedge into a predetermined position before the interior diameter prevents further downward travel on pole 12. Flutes and ridges 41, 42 prevent rotational movement of the device on the pole and also may be utilized to mate with the inner surface of the shell 30. Thus, the anti-rotation device 40 locks the non-load bearing shell 30 in proper position and prevents further movement of the shell either rotationally about the support skeleton 10*a* or vertically thereon.

The post and post base 21 and 20 may be secured together by a seam or weld 19 as depicted in FIG. 2*b* to insure that the integrity of the structure is maintained. The post 21 may extend upwards to a height of approximately 14 inches. Such a height will secure the tapered pole 12 in position while also maintaining structural integrity of the modular pole system 10 of the present invention.

Figure 3:
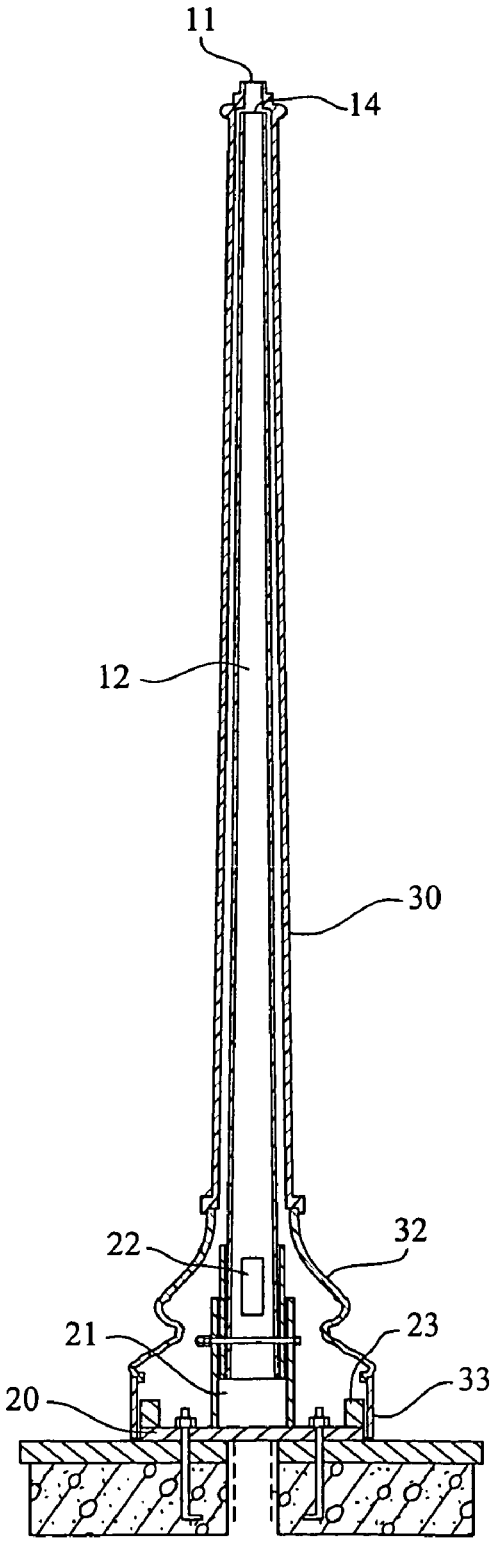
FIG. 3 is a representative side sectional view of the modular pole system shown in FIG. 1.

As shown in FIG. 3, the assembled modular pole system 10 of the present invention is depicted wherein the internal skeletal structure is comprised of the tapered pole 12, post 21 and post base 20. As shown therein, the post base 20 is secured to the ground by anchors 29 while the plurality of prongs 23 secure the base cover 33 in position by outward pressure or direct contact to base cover 33. Capture or securing prongs 23 may be utilized to abut against the base cover 33 and provide outward placement pressure on the base cover 33 to assure that the external shell 30 remains in correct position. Prongs 23 may be placed along the peripheral edge of the base 21, on the top surface as shown or extending outwardly from the side edge. Such variations in the design are considered to fall within the teachings set forth herein. The shell base and base cover extend downwardly from the vertical portion of the shell 30, all of which are integral such that the entire shell extending from the collar 14 downward to the prongs 23 may be slipped over the internal skeletal structure depicted. The design set forth therefore allows for the secure affixation of the shell 30 and is therefore accomplished without any fasteners.

As additionally seen from FIG. 1 and FIG. 3, the light fixture 35 is directly attached to the load bearing support skeleton 10*a* by attachment directly to the upper end 11 of the support pole 12. As shown, the pole 12 extends upward past the upper end of the decorative non-load bearing shell 30 thereby exposing the upper end 11. Exposed upper end 11 of the load bearing pole 12 and support skeleton 10*a* allows for the direct affixation of the light fixture 35 to the pole and support skeleton. Thus, the pole 10, which may be viewed as an integral portion of the support skeleton 10*a* since, after construction, all pieces are firmly affixed together, supports the entire weight of the fixture 35 and the decorative shell 30 is merely compressed between the fixture 35 and the ground. The fixture 35 may be secured to the upper end 11 of pole 12 by set screws, friction fit, clamps and other mechanism well known in the art.

The design of the system 10 of the present invention allows for easy installation and retrofit of previously existing standards. Particularly, since the shell 30 is of a lightweight design, it may be installed over the exterior of the support skeleton 10*a* with relative ease while assuring the rigidity of the device by the underlying structure. The exterior appearance can be constructed out of a number of lightweight materials as the design set forth herein does not necessarily require the decorative external shell to support the weight typically required for lighting standards. As set forth in one embodiment herein, the fixture 35 is directly affixed to the underlying skeletal structure and does not require support from the external portion of the standard.

Figure 5:
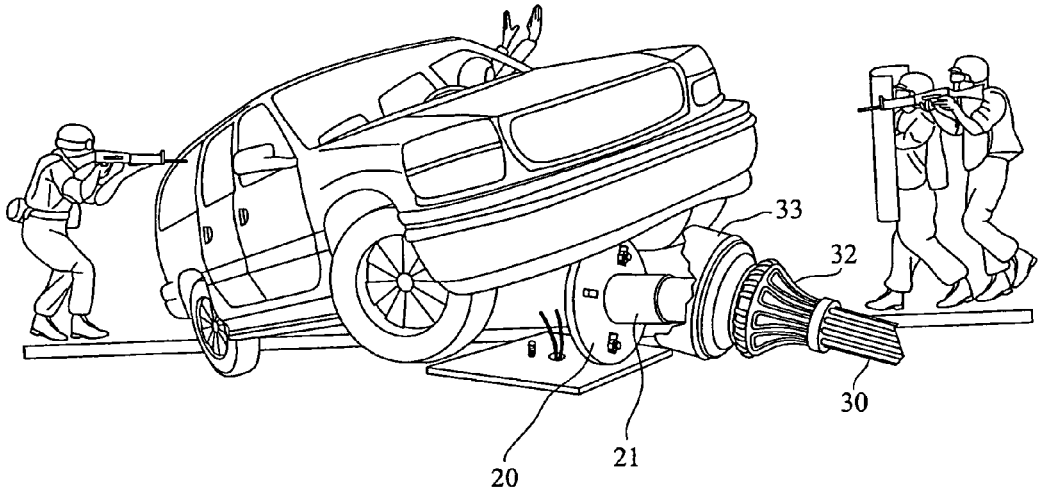
FIG. 5 is a perspective view of the modular pole system for light fixture of the present invention and use.

As constructed, the modular pole system 10 of the present invention may also provide a passive defense measure in that the rigid internal skeletal structure may provide a significant defensive measure thereby preventing intrusion of vehicles and the like due to the base plate 20 and post 21. As shown, the base 20 is anchored to the ground by a plurality of anchor bolts 24 and anchor rods 29. While standard street light fixtures, even when constructed of metalized framework, are affixed to the ground in order to assure their vertical stability, prior art lighting standards are not designed for significant structural rigidity to prevent vehicular assault. The design of the present invention may be utilized such that if a vehicle were to overrun the modular pole system and light fixture 10 of the present invention, it would be prevented from further advancement due to the galvanized steel base and post design setforth herein. Thus, the defensive measure aspect of the present invention may mask a vehicular intrusion security system with a decorative external plastic lighting standard which, to all external appearance, does not have significant rigidity necessary for a vehicle intrusion security system as described herein. However, the internal skeletal framework comprised of the 18 inch round base which is securely anchored to the ground, will provide a static defense to vehicular assault. The design may be utilized to halt lighter vehicles. If a vehicle were to attempt to overrun the modular pole system and light fixture 10 of the present invention as shown in FIG. 5, the vertical post 21 would tip forward under the weight of the forward movement of the vehicle. As the post 21 and base 20 are integral, this action would also cause the base 20 to flip upward thereby catching the underside of the vehicle chassis and potentially hanging the vehicle up to prevent additional forward movement.

Many varying constructions may be utilized in order to compose the modular pole system and light fixture of the present invention. The internal skeleton and external shell disclosed herein provides for a simplistic mechanism for installing a plastic shell assembly over the top of an internal skeletal structure. Various modification may also be made to the internal skeletal structure to provide the same functionality disclosed. Such modifications fall within the teachings set forth within this disclosure. Any such modifications either to the internal skeletal structure, base and pole design in addition to the external shell while performing similar functionality are felt to fall within the teachings herein and no unnecessary limitations are to be construed by the specific embodiments and examples disclosed.

The invention claimed is:

1. A modular decorative lighting standard, comprising:

a support pole having an upper end and a lower end, said lower end resting within a support post, said support post affixed to and extending upward from a base;

a light fixture affixed to said upper end of said support pole;

an external shell extending from said upper end of said support pole to said base, said external shell having a base cover at a lower end surrounding said base;

said external shell having a continuous internal surface along said base cover at said lower end wherein said base is in adjacent contact with said base cover of said external shell; and, a compression slip fitter positioned on said lower end of said suport pole and surrounded by said support post.

2. The modular decorative lighting standard of claim 1 further comprising a cross bolt extending through said support post, said slip fitter and said support pole.

3. The modular decorative lighting standard of claim 1 further comprising a at least one anchor rod extending through said base.

4. A modular decorative lighting standard, comprising:

an external shell spaced from an internal skeleton sctruture, said internal skeleton structure having support pole integral with a base;

said base having a plurality of anchors extending from said base to an adjacent substrate;

said external shell surrounding said pole and extending upwardly along said support pole a preselected length;

a base cover disposed at a lower end of said external shell and covering said base, and a lower end of said pole;

an anti-rotational mechanism extending about the circumference of said support pole along at a position said preselected length and engaging said external shell;

a sleeve cap disposed on said pole at an upper end of said external shell; and, a fixture connected to an upper end of said support pole.

5. The modular decorative lighting standard of claim 4, said sleeve cap disposed adjacent an upper end of said support pole.

6. The modular decorative lighting standard of claim 5, said external shell extending to an upper end of said support pole.

7. The modular decorative lighting standard of claim 4, said support pole extending through sleeve cap.

8. A modular decorative lighting standard, comprising:

an external shell surrounding an internal support structure;

said internal support structure comprising a support pole extending upwardly from a buried position within a substrate;

said external shell extending upwardly a preselected length along said support pole;

an anti-rotational mechanism extending about the circumference of said support pole and disposed at a position along said preselected length of said support pole between an outer surface of said support pole and an inner surface of said external shell;

a base cover engaging a lower end of said external shell and covering said pole where said pole extends into said substrate;

a sleeve cap positioned adjacent an upper edge of said external shell; and, a light fixture positioned on said upper distal end of said support pole.

9. The modular decorative lighting standard of claim 8, said sleeve cap positioned on an upper distal end of said support pole.

10. The modular decorative lighting standard of claim 9, said external shell extending to an upper portion of said support pole.

11. The modular decorative lighting standard of claim 8 wherein an upper end of said support pole extends through said sleeve cap.

12. A modular pole system for a lighting fixture, comprising:

an external shell spaced from an internal skeleton structure, said internal skeleton structure having support pole fitting within a base and base post;

said base post affixed to and extending upwardly from said base end surrounding a lower section of said pole;

said external shell surrounding said pole and extending a preselected length along said support pole;

a base cover engaging a lower portion of said external shell and covering said base post and a lower portion of said post;

a cap sleeve disposed on said support pole adjacent an upper end of said external shell;

wherein said base has a plurality of anchors extending downward and affixed thereto;

an anti-rotational mechanism disposed on said pole between said pole and said external shell and engaging an inner surface of said external shell.

13. The modular pole system of claim 12, said cap sleeve disposed on said support pole at an upper end of said support pole.

14. The modular pole system of claim 13, said external shell extending to an upper portion of said support pole.

15. The modular pole system of claim 12, said support pole extending through said cap sleeve.

* * * * *